US010583648B2

(12) United States Patent
Morita

(10) Patent No.: US 10,583,648 B2
(45) Date of Patent: Mar. 10, 2020

(54) INKJET RECORDING DEVICE

(71) Applicant: Konica Minolta, Inc., Chiyoda-ku, Tokyo (JP)

(72) Inventor: Shinji Morita, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/260,666

(22) Filed: Jan. 29, 2019

(65) Prior Publication Data

US 2019/0232640 A1 Aug. 1, 2019

(30) Foreign Application Priority Data

Jan. 31, 2018 (JP) ..... 2018-014247

(51) Int. Cl.
*B41J 2/005* (2006.01)

(52) U.S. Cl.
CPC ..... *B41J 2/0057* (2013.01)

(58) Field of Classification Search
CPC ..... B41J 2/0057
See application file for complete search history.

(56) References Cited

FOREIGN PATENT DOCUMENTS

| | | | |
|---|---|---|---|
| JP | 2010113280 A | * | 5/2010 |
| JP | 2015516315 A | | 6/2015 |
| WO | 2013/136220 A1 | | 9/2013 |

OTHER PUBLICATIONS

IP.com search (Year: 2019).*
Machine Translation of "Transfer Device and Image Forming Apparatus", Hoshino, Seiji et al., May 20, 2010, [Paragraphs 0022-0025, 0043-0044] (Year: 2010).*

* cited by examiner

*Primary Examiner* — Lisa Solomon
(74) *Attorney, Agent, or Firm* — Cantor Colburn LLP

(57) ABSTRACT

An inkjet recording device includes an intermediate transfer belt, a discharger, a driving belt, a supporting member, and an adhesion unit. The intermediate transfer belt is endless and supports an intermediate image. The discharger forms the intermediate image by discharging ink onto an outer face of the intermediate transfer belt. The driving belt is endless and arranged on an inner side of the intermediate transfer belt and drives the intermediate transfer belt to run. The supporting member is arranged on an inner side of the driving belt to support the intermediate transfer belt and has a plane which is parallel to the discharger and which contacts an inner face of the driving belt facing the outer face of the driving belt and covering the area of ejection by the discharger. The adhesion unit causes the intermediate transfer belt and the driving belt to adhere to one another.

13 Claims, 4 Drawing Sheets

INKJET RECORDING DEVICE

CROSS REFERENCE TO RELATED APPLICATIONS

The present invention claims priority under 35 U.S.C. § 119 to Japanese Application No. 2018-014247, filed Jan. 31, 2018, the entire content of which is incorporated herein by reference.

BACKGROUND

Technological Field

The present invention relates to an inkjet recording device.

Description of the Related Art

Inkjet recording devices are used to record images, etc. on recording media by ink discharge from nozzles. Conventionally, there have been known inkjet recording devices of the intermediate transfer type, in which an intermediate image(s) is formed by ink discharge onto an endless intermediate transfer belt made of resin or rubber, and transferred onto a recording medium by pressing to form an image(s) on the recording medium.

In such inkjet recording devices, rollers are provided on the inner side of the intermediate transfer belt at positions facing the head faces of the head units. The object is to keep the distance from the head faces to the intermediate transfer belt constant by the tension of the intermediate transfer belt using those rollers. (e.g. see Japanese Translation of PCT International Application Publication No. 2015-516315)

In a configuration with the rollers at positions facing the head faces of the intermediate transfer belt as described above, it is difficult to accurately keep the distance from the intermediate transfer belt to all the nozzles arranged in the belt running direction. In the inkjet recording devices with the intermediate transfer belt made of resin or rubber, there may be subtle variation in the speed due to the expansion and contraction of the intermediate transfer belt with tension, or the distance between the head faces and the intermediate transfer belt may vary due to the movement up and down of the intermediate transfer belt in the direction to the head faces with the driving shakes or load alteration caused by the rotation of the intermediate transfer belt. As a result, the accuracy of the position on the intermediate transfer belt at which ink ejected from the nozzles lands deteriorates, and thus the image quality degrades. The intermediate transfer belt of resin or rubber is subject to the variation in the ambient temperature, and also, the variation in the conveyance speed of the intermediate transfer belt due to thermal contraction may lead to the quality degradation.

However, there is a limitation on the material of intermediate transfer belts so that the fixability of ink may be maintained. The intermediate belt is long in the belt running direction to cover the area of transfer onto the recording medium in the conveyance direction, and therefore requires weight reduction in view of the maintenance, replaceability, and driving load. Thus, it is desirably made of resin or rubber.

Accordingly, required is an inkjet recording device which may keep the distance between the nozzles and the intermediate transfer belt constant to form an image(s) accurately even with an intermediate transfer belt subject to external factors, such as one made of resin or rubber.

SUMMARY

The present invention is conceived in view of the above problem, and an object of the present invention is to provide an inkjet recording device of the intermediate transfer type which may accurately form images on recording media.

To achieve at least one of the objects, according to an aspect of the present invention, an inkjet recording device reflecting one aspect of the present invention includes:

an intermediate transfer belt which is endless and which supports an intermediate image to be transferred onto a recording medium;

a discharger which forms the intermediate image by discharging ink onto an outer face of the intermediate transfer belt;

a driving belt which is endless and arranged on an inner side of the intermediate transfer belt and which drives the intermediate transfer belt to run by rotating in contact with an inner face of the intermediate transfer belt in an area of ejection by the discharger;

a supporting member which is arranged on an inner side of the driving belt to support the intermediate transfer belt and which has a plane which is parallel to the discharger and which contacts an inner face of the driving belt facing the outer face of the driving belt and covering the area of ejection by the discharger; and an adhesion unit which causes the intermediate transfer belt and the driving belt to adhere to one another.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiment of the present invention will be described with reference to the drawings. However, the scope of the invention is not limited to the disclosed embodiments.

[Configuration of Inkjet Recording Device 1]

Hereinafter an embodiment of the present invention is described with reference to the drawings.

Figure 1:
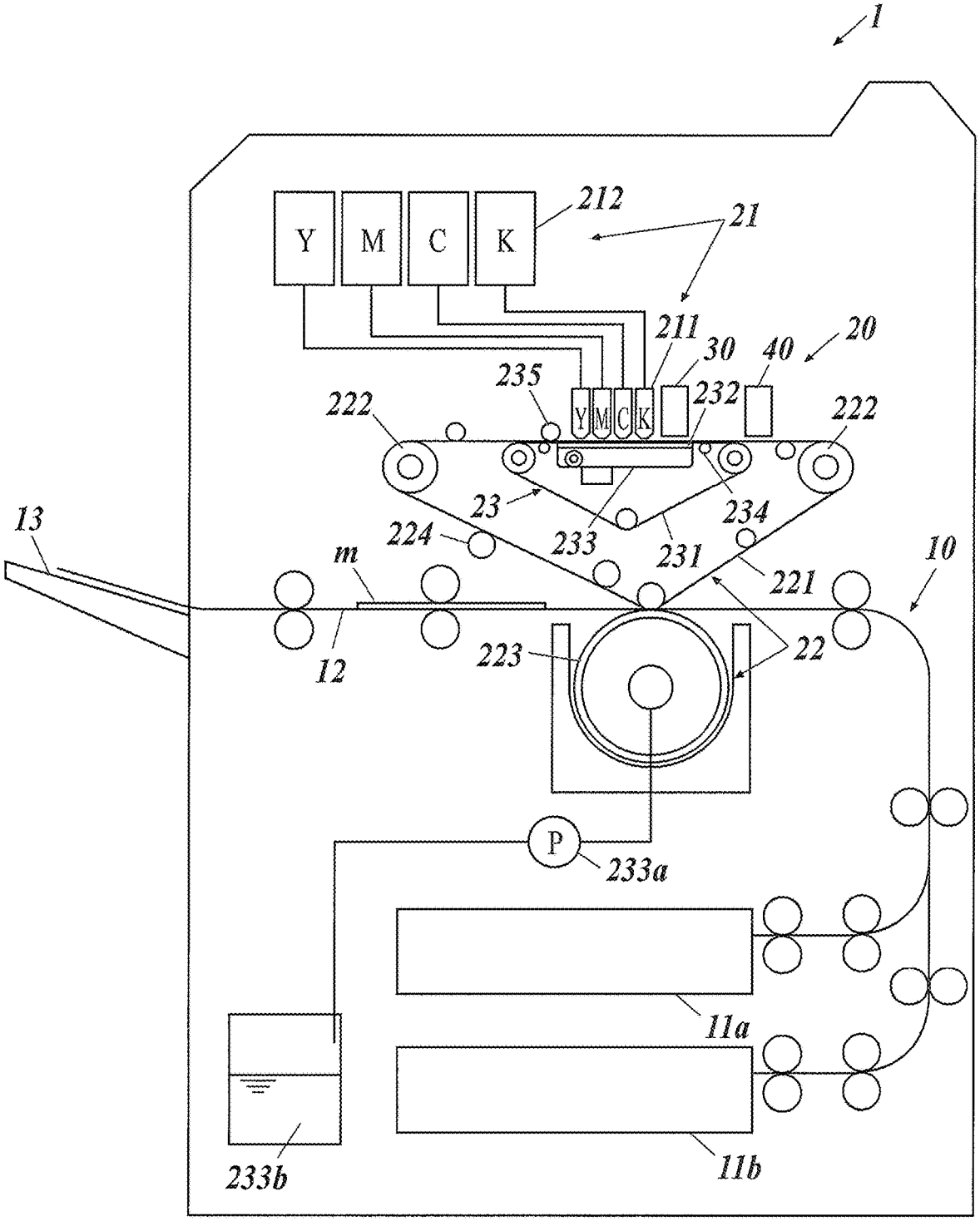
FIG. 1 shows an overall configuration of an inkjet recording device according to the present invention.
Figure 2:
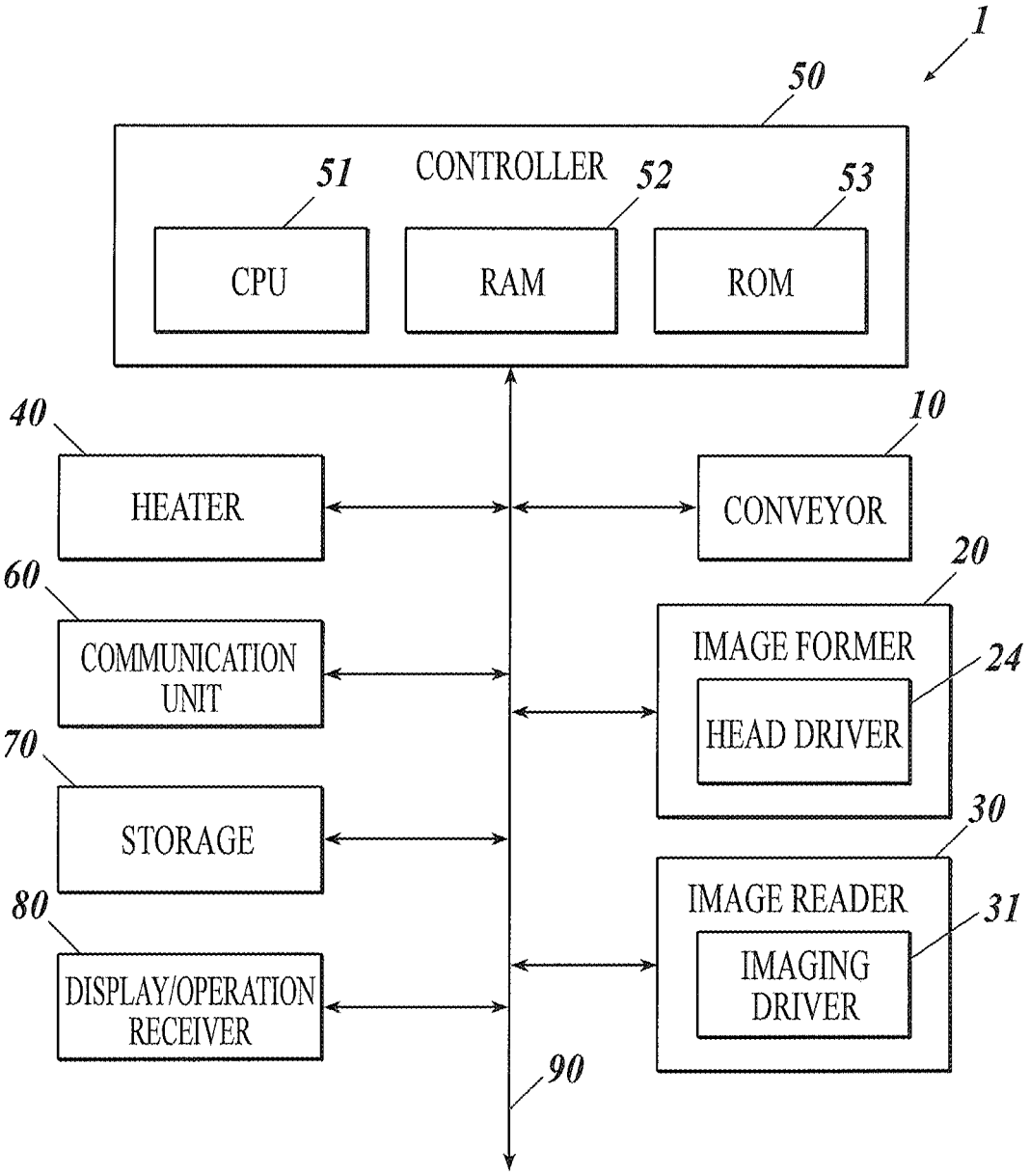
FIG. 2 is a block diagram showing a main functional configuration of the recording device 1.

FIG. 1 shows a drawing of an overall configuration of an inkjet recording device 1 in accordance with an embodiment of the present invention. FIG. 2 is a block diagram showing a main functional configuration of the inkjet recording device 1.

The inkjet recording device 1 includes a conveyor 10, an image former 20, an image reader 30, a heater 40, a controller 50, a communication unit 60, a storage 70, a display/operation receiver 80, etc. The conveyor 10, the image former 20, the image reader 30, the heater 40, the communication unit 60, the storage 70, and the display/operation receiver 80 are connected to the controller 50 via the bus 90.

The conveyor 10 is configured with a paper feeding tray 11, a conveyance mechanism 12, a paper ejection tray 13, etc.

The paper feeding tray 11 includes two paper feeding tray units 11*a* and 11*b*. Standard or irregular pieces of paper defined on the basis of the grammage or size of the recording medium m are held in the paper feeding tray units 11*a* and 11*b*, being sorted by predetermined types. The recording media m held in the paper feeding tray units 11*a* and 11*b* are sent from the top one by one and conveyed to the image former 20 by the conveyance mechanism 12 with multiple conveyance rollers.

The image former 20 is configured with a discharger 21, an intermediate transfer unit 22, an adhesion conveyor 23, etc. The detailed configuration of the image former 20 is explained below with reference to FIG. 3.

The discharger 21 has four head units 211Y, 211M, 211C, and 211K (hereinafter collectively referred to as the head units 211) which respectively discharge ink in colors of yellow, magenta, and cyan, black supplied from the respective ink tanks 212Y, 212M, 212C, and 212K (hereinafter collectively referred to as an ink storage 212). All the head units 211 have nozzles across a recordable width of the recording medium m of a predetermined size (maximum size as described later) in the width direction on the plane parallel to the conveyance face of the intermediate transfer belt 221, and may discharge ink onto the surface of the intermediate transfer belt 221 to form an intermediate image(s). The number of head units 211 is not limited to four, and ink in color other than Y, M, C, or K may be discharged. The order in which ink is discharged onto the recording medium m is not limited to the examples in the drawings.

Though ink to be discharged may be in any type, regular liquid ink is used in this embodiment. The ink is dehydrated by the operation of the heater 40 and ink in a dried state is transferred onto the recording medium m to be fixed on the recording medium m.

The intermediate transfer unit 22 is configured with the intermediate transfer belt 221, an intermediate transfer belt driving roller 222, a pressing roller 223, an intermediate transfer belt adjustment mechanism 224, etc. In the intermediate transfer unit 22, after an intermediate image(s) is formed on the surface of the intermediate transfer belt 221 by the discharger 21, the intermediate transfer belt 221 is pressed to the recording medium m by the pressing roller 223 and the intermediate image(s) on the surface of the intermediate transfer belt 221 is transferred onto the recording medium m.

The intermediate transfer belt 221 is an endless belt. The intermediate transfer belt 221 is made of a base material of metal, resin fiber fabric, etc. with an elastic layer of silicone rubber, etc. or a resin layer of fluororesin, etc. being formed on one side (transfer face) of the base material, for example. The intermediate transfer belt 221 is stretched with a porous belt 231 and a backup member 232 such that the plane facing the head faces of the head units 211 is parallel to the head faces, as described later. The conveyance speed of the intermediate transfer belt 221 is controlled to be dependent on the conveyance speed of the porous belt 231 (described later) as the controller 50 controls the rotating speed of the intermediate transfer belt driving roller 222.

The intermediate transfer belt driving roller 222 is arranged on the inner side of the intermediate transfer belt 221, stretches the intermediate transfer belt 221, and causes the intermediate transfer belt 221 to rotate in the direction A in the drawings by rotating with the driving force of the driving motor not shown in the drawings.

The pressing roller 223 is arranged at the position facing the intermediate transfer belt 221 on the conveyance path of the recording medium m. The pressing roller 223 is configured of, for example, a metal hollow shaft with many penetrating pores coated by porous material (e.g. porous ceramics, liquid permeable resin, sponge, etc.) through which liquid permeates to the hollow shaft. The pressing roller 223 which is hollow and liquid-permeable is connected to the suction pump 223*a* in FIG. 1 which sucks the liquid puddling between the intermediate transfer belt 221 and the pressing roller 223 and sends liquid to the drain container 223*b*. The pressing roller 223 is pressed to the intermediate transfer belt 221 by the momentum member such as springs not shown in the drawings.

The intermediate transfer belt adjustment mechanism 224 is configured with multiple rollers which are arranged at the positions on the inner or outer side of the intermediate transfer belt 221 to contact the suction area B at the positions on the upstream and downstream sides of the suction area B and which may rotate, being driven by the rotating movement of the intermediate transfer belt 221. The intermediate transfer belt adjustment mechanism 224 is configured to be able to press or separate from the intermediate transfer belt 221 under the control of the controller 50 and has a function to adjust the tension of the intermediate transfer belt 221.

The intermediate transfer belt adjustment mechanism 224 not only adjusts the tension of the intermediate transfer belt 221 but also presses the intermediate transfer belt 221 with the intermediate transfer belt adjustment mechanism 224 under the control of the controller 50 in a case where a gap in the conveyance speed between the porous belt 231 and the intermediate transfer belt 221 appears due to the looseness of the intermediate transfer belt 221. In that way, the looseness (or tension) is kept constant by the adjustment of the conveyance speed of the intermediate transfer belt 221.

The adhesion conveyor 23 is configured with the porous belt 231, the backup member 232, a suction mechanism 233, belt guides 234, a pressing roller 235, etc.

The porous belt 231 is an endless belt arranged on the inner side of the intermediate transfer belt 221, and contacts the intermediate transfer belt 221 on the plane facing the head units 211. The porous belt 231 is formed with metal which has higher rigidity and larger elastic modulus than the intermediate transfer belt 221 such as stainless steel, for example, and has multiple penetrating pores on its surface. The porous belt 231 functions as a driving belt.

A porous belt driving roller 231*a* which stretches the porous belt 231 and drives the porous belt 231 to rotate in the direction A in the drawings is arranged on the inner side of the porous belt 231. The porous belt driving roller 231*a* is driven by a motor not shown in the drawings to rotate.

A heater 231*b* to heat the porous belt 231 is arranged inside the porous belt driving roller 231*a*. The heater 231*b* is a halogen lamp heater, for example, and is turned on and off under the control of the controller 50. In a case where a gap appears in the conveyance speed between the porous belt 231 and the intermediate transfer belt 221, for example, the controller 50 turns on the heater 231*b* to expand the porous belt 231 by heating, etc.

A porous belt adjustment mechanism 231*c* to adjust the tension of the porous belt 231 is arranged on the inner side of the porous belt 231. The configuration of the porous belt adjustment mechanism 231*c* is common to that of the intermediate transfer belt adjustment mechanism 224. Thus, a detailed description is omitted. The porous belt adjustment mechanism 231*c* also has a function to get rid of the gap in the conveyance speed between the intermediate transfer belt 221 and the porous belt 231 similarly.

The backup member 232 is a board-shaped member formed with porous material which may permeate the air (e.g. porous ceramic, liquid-permeable resin, etc.). The backup member 232 supports the intermediate transfer belt 221 and the porous belt 231 to be parallel to the head faces, as a plane which is parallel to the head faces of the head units 211 and which has a size larger than the ejection region of the head units 211 contacts the porous belt 231 on the inner side.

The backup member 232 functions as a supporting member.

The suction mechanism 233 is generally as long as the backup member 232 in the direction A in the drawings and is arranged to contact the backup member 232 on the plane not contacting the porous belt 231.

Figure 3:
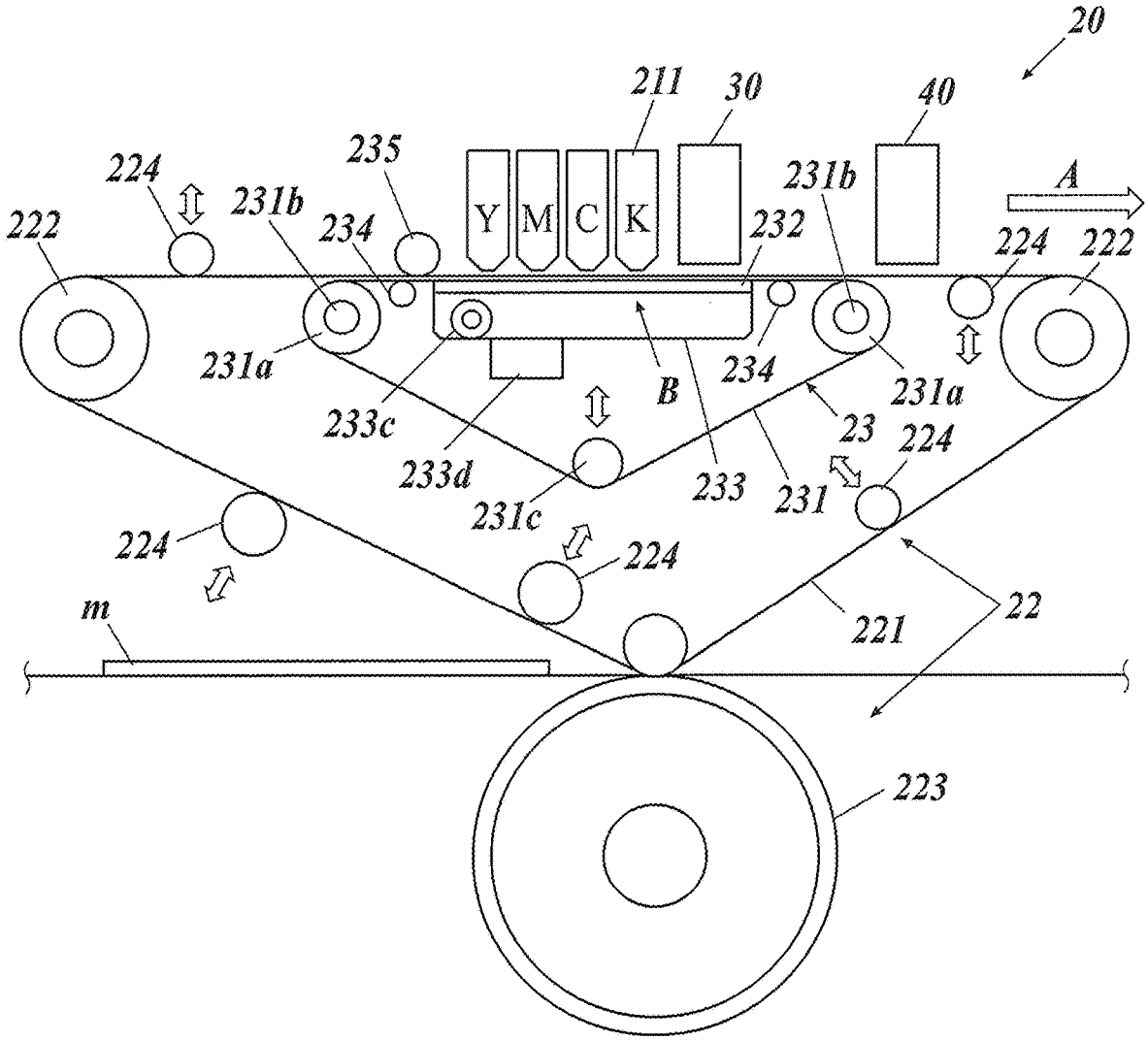
FIG. 3 shows an outlined configuration of an image former.
Figure 4A:
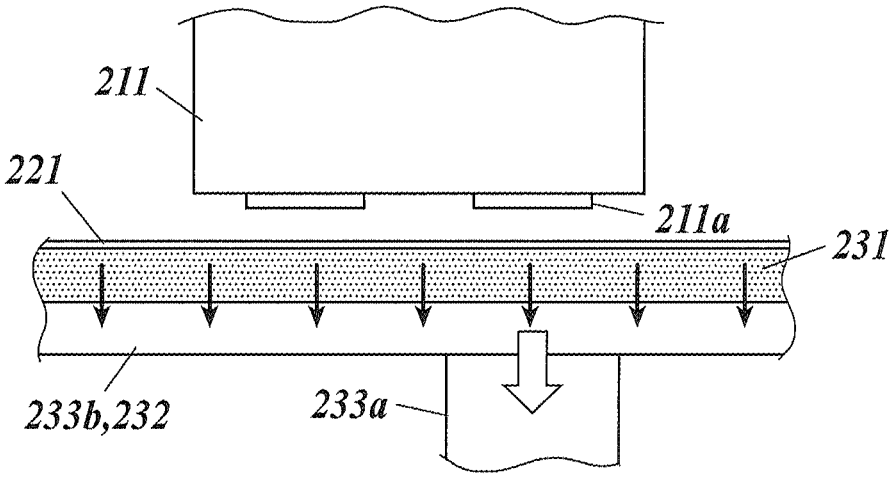
FIG. 4A shows a configuration of a suction mechanism.

The configuration of the suction mechanism 233 is described in detail with reference to FIG. 4A to FIG. 4C. As shown in FIG. 4A, the suction mechanism 233 is arranged at the position facing the head faces 211*a* of the head units 211 with the intermediate transfer belt 221, the porous belt 231, and the backup member 232 in between. The suction mechanism 233 includes a vacuum pump 233*a*, and a duct 233*b* formed inside the backup member 232, and the negative pressure inside the duct 233*b* is maintained with the suction of the vacuum pump 233*a*. As the pressure inside the suction mechanism 233 is negative, the outer air is sucked through the porous belt 231 and the backup member 232 which are air-permeable, and as a result, the intermediate transfer belt 221 is adhered to the porous belt 231. An open valve 233*c* and a pressure sensor 233*d* are included in the suction mechanism 233 to keep the inside negative pressure constant, as shown in FIG. 3.

The suction mechanism 233 functions as an adhesion unit. The area where the intermediate transfer belt 221 is adhered to the porous belt 231 by the suction mechanism 233 is defined as a suction area B which functions as an adhesion area.

Here, at the start of adhesion to the porous belt 231 of the intermediate transfer belt 221, the suction area B is linear (pointed).

Figure 4B:
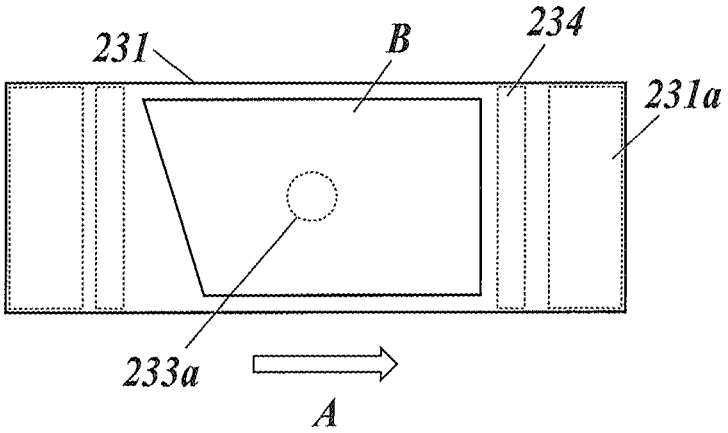
FIG. 4B shows a form of a suction area.
Figure 4C:
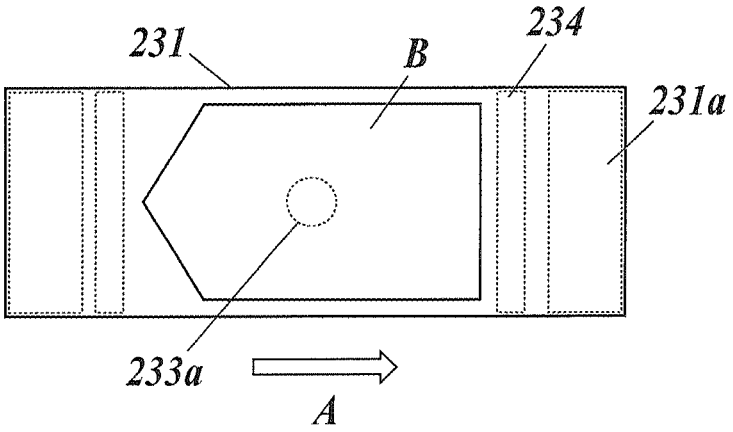
FIG. 4C shows a form of a suction area.

FIG. 4B and FIG. 4C are drawings of the suction area B of the intermediate transfer belt 221 viewed from the top (side of head units 211). In FIG. 4B, the edge of the suction area B on the upstream side in the belt running direction A is formed to be in a convex shape in the width direction of the intermediate transfer belt 221. With such a shape of the suction area B, the intermediate transfer belt 221 is adhered to the porous belt 231 at the edge in the width direction first and the adhesion area gets larger in the width direction as the intermediate transfer belt moves in the belt running direction A. Thus, it is less likely to form wrinkles on the surface of the intermediate transfer belt 221 than in a case where it is adhered abruptly in the whole area in the width direction of the intermediate transfer belt 221. In FIG. 4C, the central part of the suction area B on the upstream side in the belt running direction A is formed to be in a convex shape in the width direction of the intermediate transfer belt 221. In that case, wrinkles decreases as in the above case.

The belt guides 234 are rollers arranged on the inner side of the porous belt 231 on the upstream and downstream sides of the backup member 232 in the direction A in the drawings. The highest position of the belt guides 234 is set to be generally as high as the contact face of the porous belt 231 and the backup member 232.

The belt guides 234 function as supporting rollers.

The pressing roller 235 is a roller arranged at a position on the outer side of the intermediate transfer belt 221 and adjacent to the upstream side of the suction area B in the direction A in the drawings. The pressing roller 235 supports the adhesion of the intermediate transfer belt 221 to the suction mechanism 233 by pressing the intermediate transfer belt 221 toward the side of the porous belt 231 from the side of the head units 211.

The image reader 30 images an intermediate image(s) formed on the intermediate transfer belt 221 by the discharger 21 and outputs the image(s) as the imaging data. The image reader 30 is arranged at the position on the outer side of the intermediate transfer belt 221 where the intermediate image(s) formed in the area adhered to the suction area B on the intermediate transfer belt 221 may be read.

The image reader 30 includes a line sensor with imaging elements arranged across a width where ink may be discharged by the head units 211 onto the recording medium m in a predetermined size (the widest size in which the image recording is possible by the inkjet recording device 1) in the width direction crossing (here, perpendicular to) the conveyance direction, for example. As one-dimensional image data in the imaging target range corresponding to the ink discharge range extended in the width direction is consecutively obtained using the line sensor with the intermediate transfer belt 221 being moved by the intermediate transfer belt driving roller 222 relatively to the image reader 30 in the conveyance direction, a two-dimensional image(s) on the recording medium m may be obtained.

The heater 40 is arranged on the downstream side of the head units 211 in the running direction of the intermediate transfer belt 221. The heater 40 heats ink of the intermediate image(s) formed on the intermediate transfer belt 221, by heating the air in response to the conducted electricity with a heating wire or by infrared irradiation, for example. Ink is completely dried or almost all liquid carriers are dried in this way. Then, as a result, the resin and the coloring agent alone in ink which is heated up to the point where the viscosity increases are left, and the intermediate image(s) is transferred onto the recording medium m by pressing of the pressing roller 223.

The controller 50 performs the control operation to integrally control the overall operation of the inkjet recording device 1. The controller 50 performs the processing concerning the inspection and adjustment (correction) of the whole image quality or the ink discharge from each of the nozzle openings on the basis of a test image(s) formed by the image former 20 and read by the image reader 30. The controller 50 also functions as an adhesion controller to adjust the open valve 233*c* on the basis of the values detected by the pressure sensor 233*d*.

The controller 50 includes a CPU (Central Processing Unit) 51, a ROM (Read Only Memory) 52, a RAM (Random Access Memory) 53, etc. The CPU 51 executes the processing concerning the various kinds of control by various kinds of calculation processing. The control programs concerning the various kinds of control are stored in the ROM 52. A mask ROM, a read-write non-volatile memory, or a combination thereof may be used as the ROM 52.

The RAM 53 provides CPU 51 with working memory space and stores temporary data and various settings therein.

Various kinds of volatile memory such as SRAM, DRAM, etc. or a combination thereof may be used as the RAM 53.

The head driver 24 outputs driving signals for the operation of the ink discharge mechanism in each of the head units 211 and causes ink to be discharged from the nozzle openings to be in operation at appropriate timings. The driving signals are output to each of the head units 211 in parallel. The driving signals are also output, being synchronized to an encoder not shown in the drawings which measures the conveyance speed (position) of the porous belt 231. Accordingly, in the ink discharge mechanism, the discharge is controlled according to the signals (the conveyance speed of the porous belt 231 or the encoder signals of the porous belt driving roller 231*a*) of the conveyance speed of the porous belt 231, not the intermediate transfer belt 221. The head driver 24 functions as the discharge controller.

The ink discharge mechanism may be of a piezoelectric type or a thermal type, for example, though not limited thereto. In the piezoelectric type, pressure is added in a predetermined pattern to ink in the ink flow path as voltage is applied to deform piezoelectric elements arranged along the ink flow path communicating the nozzles. In the thermal type, as ink is heated and partly evaporated with a wire being heated by current flow, pressure is added to ink from the variation of volume.

The imaging driver 31 causes the image reader 30 to perform various operations concerning the reading of image(s) on the recording medium m. The imaging data from the data of the amount of incident light detected by the operation of the line sensor is generated, and the imaging data is output to the controller 50 (RAM 53) or the storage 70. The imaging data may be directly output to the RAM 53 or the storage 70 via the DMA (Direct Memory Access) without the control of the CPU 51. A predetermined operation of calibration may be performed at the time of conversion from the data of the amount of incident light into the imaging data.

The communication unit 60 obtains image data to be recorded or print job(s) from an external computer terminal or print server and outputs status signals concerning the image recording operation.

The storage 70 stores the image data to be recorded obtained via the communication unit 60, the processing data concerning the obtained image data, etc. The storage 70 also stores correction data including information on a nozzle which discharges ink falsely and information on the complement of that nozzle. The storage 70 may store various programs to be executed concerning the image recording operation. The CPU 53 reads out the stored programs for execution and loads them in the RAM 53. An HDD (Hard Disk Drive) or flash memory may be used as the storage 70, and a RAM may also be used in combination thereof.

The display/operation receiver 80 displays the menu of the user input reception, the status information, etc. on the display screen, and outputs the operation signals to the controller 50 in response to the input operation by the user. Here, the display/operation receiver 80 includes, for example, a liquid crystal display with touch sensors thereon and its driver. Alternatively, a display screen of other display methods, such as an organic electroluminescent display may be used for the display, and an LED light for showing the status may be used in combination thereof. Instead of or in addition to a touch panel, push button switches, rotary switches, or a numeric keypad may be used for the operation reception.

The bus 90 is a signal path for transmitting signals between the controller 50 and other units. The commands for the image reader 30, the data read by the image reader 30, the driving control signals to the heater 40 are transmitted via the bus 90 from/to the controller 50.

[Effects]

As described hereinbefore, the inkjet recording device 1 according to this embodiment includes the discharger 21, the intermediate transfer belt 221, the endless porous belt 231, the backup member 232, and the suction unit 233. The discharger 21 discharges ink onto the intermediate belt 221 to form an image(s). The porous belt 231 is arranged on the inner side of the intermediate transfer belt 221 and drives the intermediate transfer belt 221 to run by rotating in contact with the inner side of the ejection area of the head units 211 of the intermediate transfer belt 221. The backup member 232 is arranged on the inner side of the porous belt 231 and supports the porous belt 231 by causing the plane surface parallel to the head faces of the head units 211 to contact the internal face which covers the ejection area of the head units 211 and faces the external face contacting the intermediate transfer belt 221 of the porous belt 231. The suction unit 233 sucks the intermediate transfer belt 221 and the porous belt 231 to adhere to each other. The backup member 232 causes the plane covering the area of ejection from the head units 211 to contact the porous belt 231.

Thus, in the inkjet recording device 1 according to this embodiment, as the intermediate transfer belt 221 may be a plane in the whole area facing the head faces, the distance between the nozzles and the intermediate transfer belt 221 constant to form an image(s) accurately even with an intermediate transfer belt 221 subject to external factors, such as one made of resin or rubber.

The intermediate transfer belt 221 includes an elastic layer (made of silicone rubber, for example) or a resin layer (made of fluororesin), and the porous belt 231 is made of a material with a higher rigidity and a larger elastic modulus than that. The porous belt 231 is preferably made of metal, or more preferably, made of stainless steel.

Accordingly, the stable conveyance is possible as the porous belt is not easily affected by the tension of the intermediate transfer belt 221 or the expansion and contraction due to the temperature variation.

The backup member 232 is made of porous resin. Accordingly, the intermediate transfer belt 221 may be adhered to the porous belt 231 by the suction mechanism 233 through the backup member 232.

The suction mechanism 233 includes an opening valve 233*c* and a pressure sensor 233*d* for taking in the outer air. This keeps the negative pressure inside the suction mechanism 233 constant.

As the suction area B is formed to be larger in the width direction of the intermediate transfer belt 221 along with the running of the intermediate transfer belt 221 as described above, it is less likely to form wrinkles on the surface of the intermediate transfer belt 221 than in a case where the intermediate transfer belt 221 is sucked abruptly in the whole area in the width direction of the intermediate transfer belt 221.

The pressure roller 235 to press the intermediate transfer belt 231 to the porous belt 231 is arranged adjacent to the upstream side of the suction area B in the running direction of the intermediate transfer belt 221. Thus, the intermediate transfer belt 221 is sucked to the porous belt 231 more.

The intermediate transfer belt adjustment mechanism 224 is arranged on the upstream and downstream sides of the suction area B of the intermediate transfer belt 221. In a case where there is a gap in the speed between the intermediate transfer belt 221 and the porous belt 231 due to the contraction and expansion of the intermediate transfer belt 221, it is possible to fill the gap in the speed by modification of the pressing intensity of the intermediate transfer belt adjustment mechanism 224.

The highest position of the belt guides 234 is set to be generally as high as the contact face of the porous belt 231 and the backup member 232.

Thus, as no gap appears between the area where the porous belt 231 touches the backup member 232 and the area outside of it, it is not likely to form unnecessary wrinkles on the intermediate transfer belt 221.

It is possible to fill a gap in the conveyance speed with the heater 231*b* which may heat the porous belt 231. In a case where there is a gap in the conveyance speed between the porous belt 231 and the intermediate transfer belt 221, for example, the porous belt may be expanded by heating.

The image reader 30 is arranged in the suction area B and reads an intermediate image(s) formed on the intermediate transfer belt 221. Accordingly, the image(s) may be detected accurately as the area conveyed is read in a state where the intermediate transfer belt 221 is kept plane in shape.

The intermediate transfer belt 221 rotates dependent on the conveyance speed of the porous belt 231. The ink discharge from the head units 211 is controlled by the head driver 24 according to the conveyance speed of the porous belt 231. Accordingly, the image may be formed accurately as the ink discharge is controlled on the basis of the porous belt 231 which does not easily vary the speed.

In the inkjet recording device 1 according to this embodiment, as the intermediate transfer belt 221 is adhered to the backup member 232 through the porous belt 231, there are advantages shown below in comparison to a configuration in which the intermediate transfer belt 221 is adhered to the backup member 232 without the porous belt 231.

Without the porous belt 231, the tension of the intermediate transfer belt 221 easily gets uneven due to the friction between the intermediate transfer belt 221 and the backup member 232, and the temperature of the intermediate transfer belt 221 gets uneven due to the friction heat, causing a gap in the tension. In comparison to this, such a problem is less likely to occur in the present invention with the porous belt 231 which rotates with the intermediate transfer belt 221.

There may be unevenness in the tension when the tension of the intermediate transfer belt 221 is adjusted, when a winding is adjusted, when the pressure to transfer to the recording medium m is adjusted, or when the recording medium m enters the transfer area (a part where the intermediate transfer belt 221 and the pressing roller 223 are pressed to contact each other). However, unevenness in the tension is less likely to appear at the time of such adjustment, etc., as the porous belt 231 which has a higher rigidity than the intermediate transfer belt 221 is attached.

In this embodiment, the intermediate transfer belt 221 is adhered to the porous belt 231 by suction, though not limited thereto. For example, the porous belt 231 and the intermediate transfer belt 221 may be adhered to each other with static electricity or electromagnetic force.

The suction mechanism 233 in the above embodiment uses the vacuum pump 233*a*, though not limited thereto, as long as the negative pressure inside the suction unit 233 may be realized. For example, a blower or a fan may be used.

Other Embodiments

The matters described in the above embodiments are some of preferred examples of the invention, and not intended to limit the invention.

For example, in the above, as a computer-readable medium for the programs of the present invention, a non-volatile memory, hard disk, etc. is used, though not limited thereto. A portable recording/storage medium, such as a CD-ROM, may be used as an alternative computer-readable medium. Further, as a medium to provide data of the programs of the present invention via communication network, a carrier wave may be used.

In addition to the above, the specific configuration/components and the specific operations of the inkjet recording device can also be appropriately modified without departing from the scope of the invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-014247, filed on 31 Jan. 2018, is incorporated herein by reference in its entirety.

What is claimed is:

1. An inkjet recording device comprising:

an intermediate transfer belt which is endless and which supports an intermediate image to be transferred onto a recording medium;

a discharger which forms the intermediate image by discharging ink onto an outer face of the intermediate transfer belt;

a driving belt which is endless and arranged on an inner side of the intermediate transfer belt and which drives the intermediate transfer belt to run by rotating in contact with an inner face of the intermediate transfer belt in an area of ejection by the discharger;

a supporting member which is arranged on an inner side of the driving belt to support the intermediate transfer belt and which has a plane which is parallel to the discharger and which contacts an inner face of the driving belt facing the outer face of the driving belt and covering the area of ejection by the discharger; and an adhesion unit which causes the intermediate transfer belt and the driving belt to adhere to one another.

2. The inkjet recording device according to claim 1, wherein the intermediate transfer belt is a belt made of resin or rubber, and wherein the driving belt is a belt made of a member which has a higher rigidity and a larger elastic modulus than the intermediate transfer belt.

3. The inkjet recording device according to claim 2, wherein the driving belt is a belt made of metal.

4. The inkjet recording device according to claim 1, wherein the supporting member is made of porous resin.

5. The inkjet recording device according to claim 1, wherein the driving belt has a plurality of penetrating pores, and wherein the adhesion unit forms an adhesion area and causes the intermediate transfer belt to adhere to the driving belt by making a pressure of the adhesion area negative, wherein the adhesion area is on a face of the adhesion unit opposite to a plane where the supporting member contacts the driving belt.

6. The inkjet recording device according to claim 5, wherein the adhesion unit includes an opening valve and a pressure sensor for taking in outer air into the adhesion area, the inkjet recording device comprising an adhesion controller which adjusts the opening valve based on a detected value of the pressure sensor.

7. The inkjet recording device according to claim 5, wherein the adhesion area increases in a width direction of the intermediate transfer belt with the intermediate transfer belt running in the adhesion area.

8. The inkjet recording device according to claim 5, comprising a pressing roller which is arranged adjacent to an upstream side of the adhesion area in a conveyance direction of the intermediate transfer belt and which presses the intermediate transfer belt toward the driving belt.

9. The inkjet recording device according to claim 5, comprising an intermediate transfer belt adjustment mechanism which is arranged on an upstream side or on a downstream side from the adhesion area in the conveyance direction of the intermediate transfer belt so as to be in contact with the inner face or outer face of the intermediate transfer belt, and which presses the intermediate transfer belt to add tension to the intermediate transfer belt.

10. The inkjet recording device according to claim 1, comprising supporting rollers which are arranged on an upstream side and a downstream side of the supporting member in a running direction of the driving belt and which rotate in contact with the inner face of the driving belt, wherein a highest position of the supporting roller is substantially as high as a face of the supporting member where the supporting member contacts the driving belt.

11. The inkjet recording device according to claim 1, comprising a heater which heats the driving belt.

12. The inkjet recording device according to claim 1, comprising an image reader which reads the intermediate image formed by the discharger in an area of the intermediate transfer belt where the intermediate transfer belt contacts the driving belt.

13. The inkjet recording device according to claim 1, comprising a discharge controller which controls a timing to eject ink from the discharger according to a running speed of the driving belt.

* * * * *